US008590759B1

(12) United States Patent
Mooney

(10) Patent No.: US 8,590,759 B1
(45) Date of Patent: Nov. 26, 2013

(54) REVERSIBLE BACKPACK

(71) Applicant: Sarah Mooney, Argyle, TX (US)

(72) Inventor: Sarah Mooney, Argyle, TX (US)

(73) Assignee: Bioworld Merchandising, Inc., Irving, TX (US)

( * ) Notice: Subject to any disclaimer, the term of this patent is extended or adjusted under 35 U.S.C. 154(b) by 0 days.

(21) Appl. No.: 13/748,567

(22) Filed: Jan. 23, 2013

Related U.S. Application Data

(60) Provisional application No. 61/589,520, filed on Jan. 23, 2012.

(51) Int. Cl.
*A45F 3/04* (2006.01)

(52) U.S. Cl.
USPC ..... 224/581; 224/627; 224/645

(58) Field of Classification Search
USPC ..... 224/578, 579, 581, 627–659
See application file for complete search history.

(56) References Cited

U.S. PATENT DOCUMENTS

| | | | | |
|---|---|---|---|---|
| 4,301,849 | A * | 11/1981 | Litwack et al. | 150/103 |
| 5,361,951 | A * | 11/1994 | Chehebar | 224/153 |
| 6,299,044 | B1 * | 10/2001 | Klindworth-Garron | 224/625 |
| 8,448,828 | B2 * | 5/2013 | Nitti | 224/153 |
| 2010/0243692 | A1 * | 9/2010 | Sabbah | 224/581 |
| 2011/0024474 | A1 * | 2/2011 | Di Stasio et al. | 224/645 |

* cited by examiner

*Primary Examiner* — Justin Larson
(74) *Attorney, Agent, or Firm* — Allen, Dyer, Doppelt, Milbrath & Gilchrist, P.A.

(57) ABSTRACT

A reversible backpack includes a backpack shell with first and second surfaces. The backpack shell is reversible through an access opening thereinto, such that either of the first and second surfaces is selectable as the exterior of the bag. One or more carrying straps are releasably connected proximate to the top of the backpack shell and, during reversal, are passed through strap openings proximate to the bottom of the backpack shell. A pocket shell located in a pocket opening of the backpack shell defines a pocket volume separated from the interior volume of the backpack shell. Pocket access openings in first and second faces of the pocket shell allow access into the pocket regardless of which backpack shell surface is exterior.

19 Claims, 2 Drawing Sheets

REVERSIBLE BACKPACK

CROSS-REFERENCE TO RELATED APPLICATION

This application claims the benefit of U.S. Provisional Application Ser. No. 61/589,520, filed on Jan. 23, 2012, the contents of which are herein incorporated by reference in their entirety.

FIELD OF THE INVENTION

The present invention relates to backpacks, and more particularly, to reversible backpacks that can be worn either outside or inside out.

BACKGROUND OF THE INVENTION

Many wearers of backpacks prefer the outer appearance of their backpacks to reflect their mood or personality. However, people being variable in mood and personality, it can sometimes be desirable to change the outer appearance of their backpacks. One option for doing this is simply to own multiple backpacks. However, this is an expensive option and only offers the flexibility to change backpack appearance when the wearer actually has the multiple backpacks with him or her.

Another option is to make a reversible backpack, where the inside and outside are finished with different appearances and the backpack can be worn with either side out. Advantageously, the number of backpacks required to have different outer appearances is reduced by half with this approach, and the wearer needs only have one backpack to be able to change outer appearances. While available reversible backpacks represent a valuable improvement to the basic backpack, further improvements are possible.

SUMMARY OF THE INVENTION

In view of the foregoing, it is an object of the present invention to provide an improved reversible backpack. According to an embodiment of the present invention, a reversible backpack includes a backpack shell and a first carrying strap. The backpack shell has a shell front, a shell back, and shell top and a shell bottom, and defines a shell interior volume, a backpack access opening proximate to the shell top, and a first strap opening proximate to the shell bottom. The backpack access opening and the first strap opening permit direct communication with the interior volume from an exterior of the shell. The backpack shell has opposed first and second shell surfaces and is reversible through the backpack access opening such that each of the first and second shell surfaces are selectable as the exterior of the backpack shell with the other of the first and second shell surfaces facing the interior volume.

According to an aspect of the present invention, the first carrying strap extends across the shell back from proximate to the shell top to proximate to the first strap opening, the first carrying strap being manually disconnectable proximate to the shell top, insertable through the first strap opening and reconnectable proximate to the shell top to keep the first carrying strap on the exterior of the backpack shell after reversal thereof.

According to another aspect of the present invention, the backpack shell further defines a pocket opening and the reversible backpack further comprises a pocket shell having first and second pocket faces extending across the pocket opening defining a pocket volume therebetween. The first pocket face is on the exterior of the backpack shell when the first shell surface forms the exterior of the backpack shell and the second pocket face is on the exterior of the backpack shell when the second shell surface forms the exterior of the backpack shell. First and second pocket access openings are defined in the first and second pocket faces, respectively, such that direct communication with the pocket volume is possible from the exterior of the backpack shell regardless of which of the first and second shell surfaces forms the exterior of the backpack shell.

According to a method aspect, a method hod of using a reversible backpack includes disconnecting an upper end of a first carrying strap proximate to a top of a backpack shell while leaving a lower end of the first carrying strap attached proximate to a first strap opening, the first strap opening being defined proximate to a bottom of the backpack shell. The method further includes inserting the first carrying strap through the first strap opening into an interior volume of the backpack shell, reversing the backpack shell through an access opening thereinto such that interior and exterior surfaces of the backpack shell are reversed, and reconnecting the first carrying strap proximate to the top of the backpack shell.

These and other objects, aspects and advantages of the present invention will be better appreciated in view of the drawings and following detailed description of preferred embodiments.

DETAILED DESCRIPTION OF PREFERRED EMBODIMENTS

Figure 2:
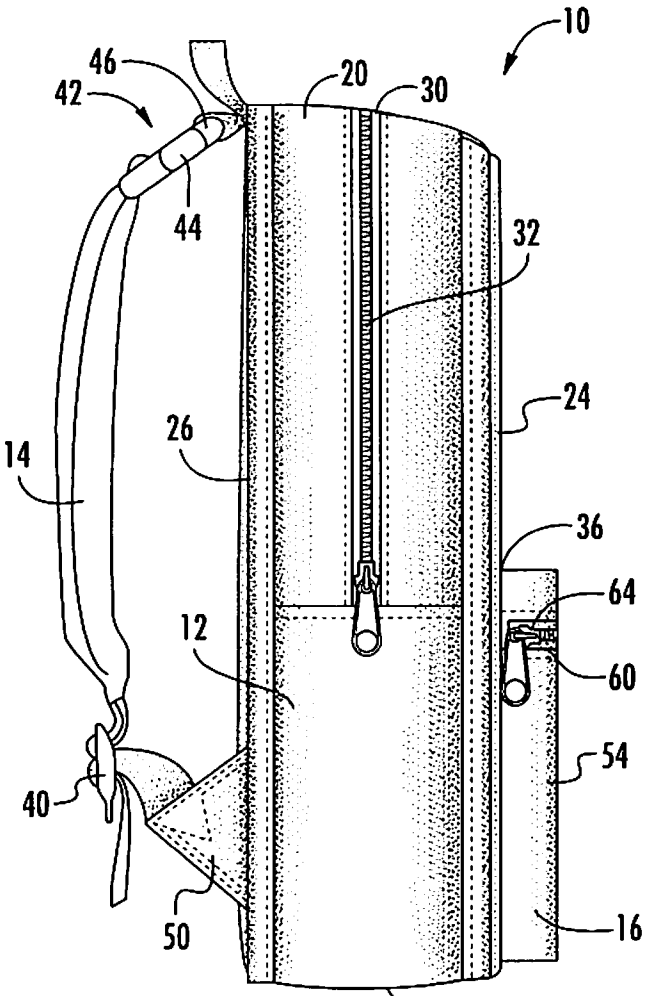
FIG. 2 is a side view of the reversible backpack of FIG. 1, reversed from the FIG. 1 configuration with a second surface facing outward.
Figure 1:
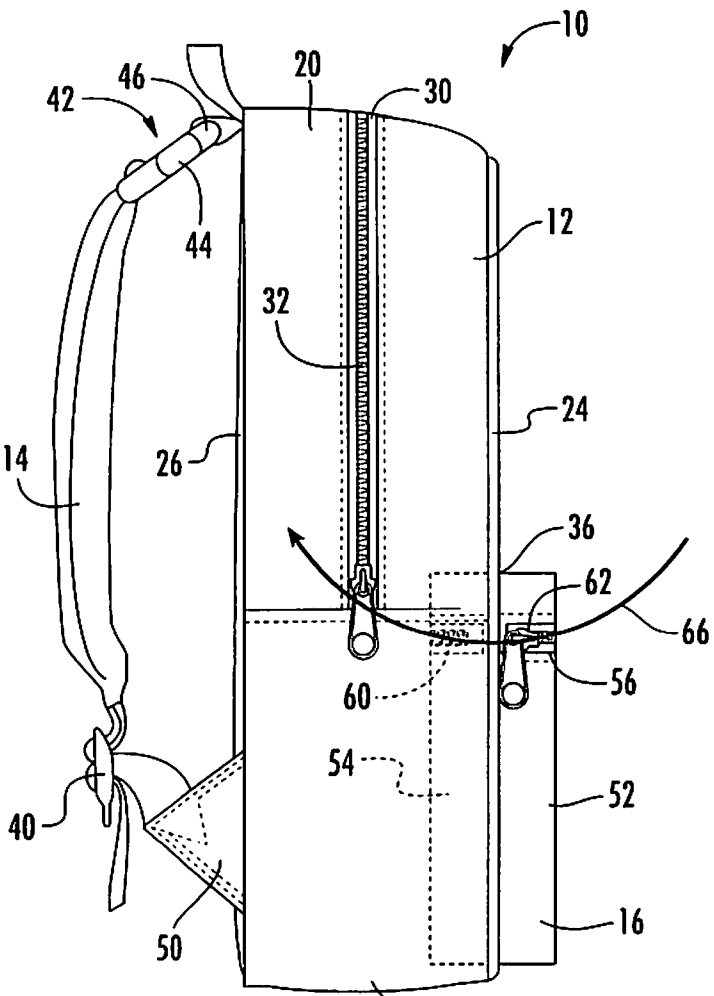
FIG. 1 is a side view of a reversible backpack, with a first surface facing outward, and with some hidden components in shown broken lines.

Referring to FIGS. 1 and 2, according to an embodiment of the present invention, a reversible backpack 10 includes a backpack shell 12 defining an interior volume therein, carrying straps 14 and a pocket shell 16 defining a pocket volume therein. The backpack she 12 includes a first surface (facing outward in FIG. 1) and a second surface (shaded and facing outward in FIG. 2) that are reversible such that either the first or the second surface can be selected as the exterior of the backpack 10, with the other of the first and second surfaces facing the interior volume of the shell 12. The carrying straps 14 are attached to the backpack shell 12 such that they can be disconnected and reconnected to remain on the exterior of the backpack shell 12 after reversal.

For referential purposes, the backpack shell 12 has a shell top 20, a shell bottom 22, a shell front 24 and a shell back 26, with the directional terms "top" and "bottom" corresponding to the general orientation of the backpack 10 when worn normally on a person standing upright and the directional terms "back" and "front" referring, respectively, to the portions oriented generally toward and away from the back of the wearer. As used herein, an element is "proximate" to a recited location such as the "top," when it is at the recited location or closer to the recited location than to its opposite—for instance, an element is proximate to the shell top if it is closer to the shell top than to the shell bottom. While the term "backpack" is used, it will be appreciated that the current invention is not necessarily limited to being worn on the back, and that other bag types incorporating features of the present invention could be used. Accordingly, "backpack" does not necessarily dictate a bag that is worn on the back.

The backpack shell 12 defines a backpack access opening 30 proximate to the shell top 22 and communicating directly with the interior volume of the shell 12, through which the backpack shell 12 is preferably reversed. A backpack access opening closure 32, such as a zipper, is preferably associated with the opening 30 for selective closing thereof.

The backpack shell 12 additionally defines a pair of strap openings 34 (see FIG. 3) proximate to opposite sides of the shell bottom 22. Lower ends of the carrying straps 14 are attached proximate to respective strap openings 34, such that the carrying straps 14 can remain attached to the backpack shell 12 at their lower ends and be passed through their respective strap opening 34 during reversal of the backpack shell 12. Advantageously, the strap openings 34 are located along seams between adjacent material panels of the backpack shell 12, taking the form of vertically extending slits made by leaving portions of the seams open. Preferably, no closures are employed in the strap openings 34, although zippers or other closures could be employed if desired.

The backpack shell 12 further defines a pocket opening 36, which is effectively closed by the pocket shell 16. In the depicted embodiment, and as will be described in greater detail below, the pocket shell 16 defines a pocket interior volume which is separated from the interior volume of the backpack shell 12.

The carrying straps 14 extend across the shell back 26 from proximate to the shell top 20 to proximate to the strap openings 34. The carrying straps 14 can be padded, as desired, and include length adjustment mechanisms 40, preferably proximate to the lower ends thereof. The carrying straps 14 are releasable connected to the backpack shell 12 proximate to the shell top 20. Although two carrying straps 14 are depicted, and believed to represent a preferred embodiment, a backpack 10 with a single strap is also possible.

Advantageously, the carrying straps 14 are releasably connected to the backpack shell 12 using quick release connectors 42. Each quick release connector 42 includes a strap connector portion 44 affixed to an upper end of its respective carrying strap 14, and two shell top connector portions 46, which are separately attachable to the strap connector portion 44. One of the two shell top connector portions 46 is affixed to the first surface (exterior in FIG. 1) and the other to the second surface (exterior in FIG. 2).

As used herein, "releasably connected" and a "releasable connection" refer to a connection that can be repeatedly made and unmade manually without tools. A "quick release" connector is a releasable connection that can be unmade by one hand in a single motion.

In the depicted embodiment, the lower ends of the carrying straps 14 are connected proximate to opposite sides of the shell bottom 22 by respective strap bottom attachment flaps 50. The strap bottom attachment flaps 50 preferably attach adjacent to an edge of the strap openings 34, and are pulled through the strap openings 34 with the straps 14 during reversal. By attaching the flaps 50 along an outer edge of their respective strap openings 34, the flaps 50 can also serve to effectively close the openings 34 to a degree while the backpack 10 is being worn.

The pocket shell 16 includes first and second pocket faces 52, 54 which define the pocket interior volume therebetween. First and second pocket access openings 56, 60 are defined in the first and second pocket faces 52, 54, respectively. First and second pocket access closures 62, 64, such as zippers, can be used to selectively close the openings 56, 60, respectively. Regardless of which of the first (FIG. 1 exterior) or second (FIG. 2 exterior) shell surfaces is outward, access to the pocket volume is possible through a respective one of the pocket access openings 56, 60.

Advantageously, a user can store multiple items in the pocket volume which do not have to be removed each time the backpack shell 12 is reversed, and are accessible from either surface. By opening both closures 62, 64, a user could also access the interior volume of the backpack shell 12 indirectly thereby, as depicted by arrow 66. Also, as seen in FIG. 1, the pocket face on the interior of the shell 12 (the second face 54 in FIG. 1) can protrude into the interior volume of the backpack shell 12.

Figure 4:
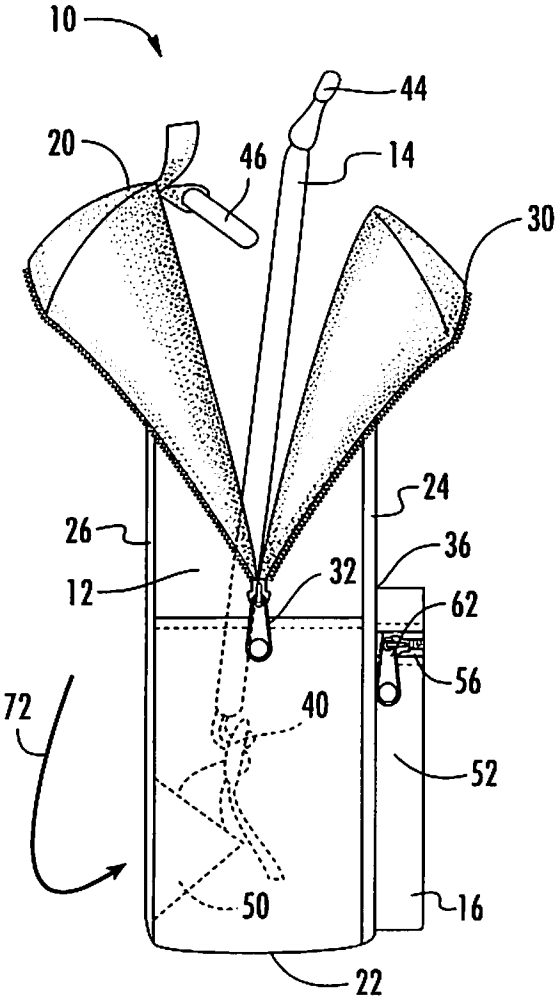
FIG. 4 is a side view of the reversible backpack of FIG. 1, during a further stage of the reversal.

The processes for reversal of the backpack 10 and shell 12 from the FIG. 1 state to the FIG. 2 and vice versa are substantially the same. For illustrative purposes, the reversal from the FIG. 1 state to the FIG. 2 state will be described with further reference to FIGS. 3 and 4.

Figure 3:
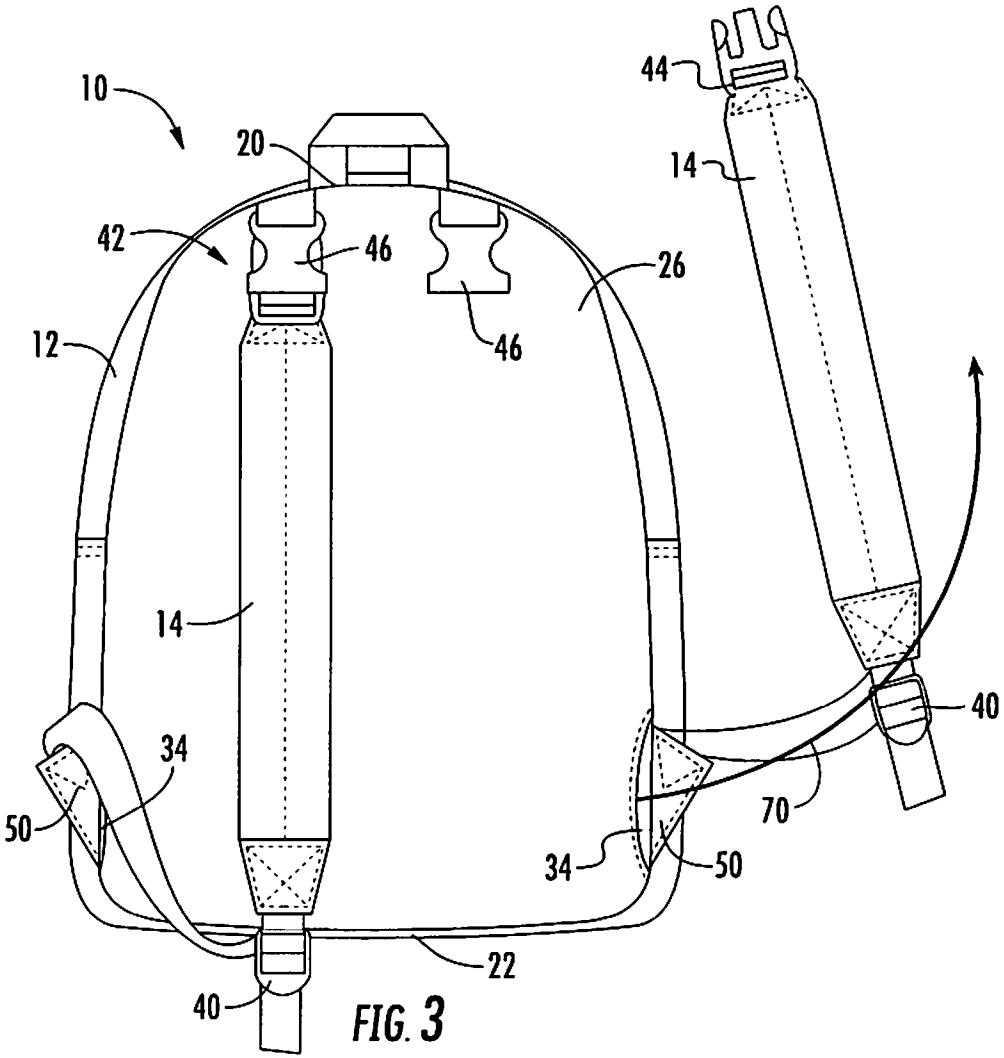
FIG. 3 is a rear view of the reversible backpack of FIG. 1, during a stage of the reversal from the FIG. 1 configuration to the FIG. 2 configuration.

In FIG. 3, the upper ends of the carrying straps 14 are detached at their releasable connections proximate to the shell top 20, by undoing both strap connector portions 44 of the quick release connectors 42 from their respective top connector portions 46. As depicted by arrows 70, 72, each strap 14 (one movement shown) is inserted through its respective strap opening 34 and drawn out through the shell access opening 30. The backpack shell 12 is reversed through the access opening 30, and the strap connector portions 44 are connected to the respective top connector portions 46 that are now on the exterior (as shown in FIG. 2). The backpack 10 reversal is complete and can be repeated as often as desired.

It will be appreciated that the steps of pulling the straps 14 through the strap openings 34 could be performed after reversing the backpack shell 12, rather than before. However, pulling the straps 14 through the openings 34 first allows the straps 14 to be used to assist in the reversal of the shell 12. This is a further advantage of the depicted backpack 10 embodiment, in which the straps 14 can remain connected proximate to the shell bottom 22 throughout the reversal. Additionally, the need for additional openings in the shell top 20 to permit strap pull-through during reversal is eliminated.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A reversible backpack comprising:

a backpack shell having a she front, a shell back, and shell top and a shell bottom, the backpack shell defining a shell interior volume, a backpack access opening proximate to the shell top, and a first strap opening proximate to the shell bottom, the backpack access opening and the first strap opening permitting direct communication with the interior volume from an exterior of the shell, the backpack shell having opposed first and second shell surfaces and being reversible through the backpack access opening such that each of the first and second shell surfaces are selectable as the exterior of the backpack shell with the other of the first and second shell surfaces facing the interior volume; and a first carrying strap extending across the she back from proximate to the shell top to proximate to the first strap opening, the first carrying strap being manually disconnectable proximate to the shell top, insertable through the first strap opening and reconnectable proximate to the shell top to keep the first carrying strap on the exterior of the backpack shell after reversal thereof.

2. The reversible backpack of claim 1, further comprising a backpack access closure selectively closing the backpack access opening.

3. The reversible backpack of claim 1, wherein the shell further defines a second strap opening proximate to the shell bottom and the reversible backpack further comprises a second carrying strap extending across the backpack shell back from proximate to the shell top to a second bottom connection point proximate to the second strap opening, the second carrying strap being manually disconnectable proximate to the shell top, insertable through the second strap opening and reconnectable proximate to the shell top to keep the second carrying strap on the exterior of the backpack shell after reversal thereof.

4. The reversible backpack of claim 1, further comprising a quick release connector having a first strap connector portion affixed to an upper end of the first carrying strap and two first shell top connector portions, each of the two first shell top connector portions being complementary with and separately attachable to the first strap connector portion, one of the two first shell top connector portions being affixed to the first shell surface proximate to shell top the for use when the first shell surface is the exterior surface and the other of the two first shell top connector portions being affixed to the second shell surface proximate to the shell top for use when the second shell surface is the exterior surface.

5. The reversible backpack of claim 1, further comprising a first strap bottom attachment flap connected to a lower end of the first strap and to the backpack shell along an edge of the first strap opening, the first strap bottom attachment flap being displaceable through the first strap opening in connection with reversal of the backpack shell.

6. The reversible backpack of claim 5, wherein the first strap bottom attachment flap is connected along an outer edge of the first strap opening.

7. The reversible backpack of claim 1, wherein the first strap opening is a vertically extending slit.

8. The reversible backpack of claim 7, wherein the vertically extending slit is an open portion of a seam between adjacent material panels of the backpack shell.

9. The reversible backpack of claim 1, wherein the backpack shell further defines a pocket opening and the reversible backpack further comprises a pocket shell having first and second pocket faces extending across the pocket opening defining a pocket volume therebetween, the first pocket face being on the exterior of the backpack shell when the first shell surface forms the exterior of the backpack shell and the second pocket face being on the exterior of the backpack shell when the second shell surface forms the exterior of the backpack shell, first and second pocket access openings being defined in the first and second pocket faces, respectively, such that direct communication with the pocket volume is possible from the exterior of the backpack shell regardless of which of the first and second shell surfaces forms the exterior of the backpack shell.

10. The reversible backpack of claim 9, further comprising first and second pocket access closures selectively closing the first and second pocket access openings, respectively.

11. A reversible backpack comprising:

a backpack shell having a shell front, a shell back, and shell top and a shell bottom, the backpack shell defining a shell interior volume, a backpack access opening proximate to the shell top, a first strap opening proximate to the shell bottom, and a pocket opening, the backpack access opening and the first strap opening permitting direct communication with the interior volume from an exterior of the shell, the backpack shell having opposed first and second shell surfaces and being reversible through the backpack access opening such that each of the first and second shell surfaces are selectable as the exterior of the backpack shell with the other of the first and second shell surfaces facing the interior volume;

a first carrying strap extending across the shell back from proximate to the shell top to proximate to the shell bottom, the first carrying strap being manually disconnectable proximate to the shell top, insertable through the first strap opening, and reconnectable proximate to the shell top to keep the first carrying strap on the exterior of the backpack she after reversal thereof; and a pocket shell having first and second pocket faces extending across the pocket opening defining a pocket volume therebetween, the first pocket face being on the exterior of the backpack shell when the first shell surface forms the exterior of the backpack shell and the second pocket face being on the exterior of the backpack shell when the second shell surface forms the exterior of the backpack shell, first and second pocket access openings being defined in the first and second pocket faces, respectively, such that direct communication with the pocket volume is possible from the exterior of the backpack shell regardless of which of the first and second shell surfaces forms the exterior of the backpack shell.

12. The reversible backpack of claim 11, further comprising first and second pocket access closures selectively closing the first and second pocket access openings, respectively.

13. The reversible backpack of claim 11, further comprising a second carrying strap extending across the backpack shell back from proximate to the shell top to proximate to the shell bottom, the second carrying strap being manually disconnectable and reconnectable to keep the second carrying strap on the exterior of the backpack shell after reversal thereof.

14. The reversible backpack of claim 11, wherein the pocket opening is proximate to the shell front.

15. A reversible backpack comprising:

a backpack shell having a she front, a shell back, and shell top and a shell bottom, the backpack shell defining a shell interior volume, a backpack access opening proximate to the shell top, first and second strap openings proximate to opposite sides of the shell bottom and a pocket opening, the backpack access opening and the first strap opening permitting direct communication with the interior volume from an exterior of the shell, the backpack shell having opposed first and second shell surfaces and being reversible through the backpack access opening such that each of the first and second shell surfaces are selectable as the exterior of the backpack shell with the other of the first and second shell surfaces facing the interior volume;

first and second carrying straps extending across the shell back from proximate to the shell top to proximate to the first and second strap openings, respectively, the first and second carrying straps being manually disconnectable proximate to the shell top, insertable through the first and second strap openings, respectively, and reconnectable proximate to the shell top to keep the first and second carrying straps on the exterior of the backpack shell after reversal thereof; and a pocket shell having first and second pocket faces extending across the pocket opening defining a pocket volume therebetween, the first pocket face being on the exterior of the backpack shell when the first shell surface forms the exterior of the backpack shell and the second pocket face being on the exterior of the backpack shell when the second shell surface forms the exterior of the backpack shell, first and second pocket access openings being defined in the first and second pocket faces, respectively, such that direct communication with the pocket volume is possible from the exterior of the backpack shell regardless of which of the first and second shell surfaces forms the exterior of the backpack shell.

16. The reversible backpack of claim 15, further comprising:

a backpack access closure selectively closing the backpack access opening; and first and second pocket access closures selectively closing the first and second pocket access openings, respectively.

17. The reversible backpack of claim 15, further comprising first and second strap bottom attachment flaps connected to lower ends of the first and second carrying straps, respectively, and to the backpack shell along outer edges of the first and second strap openings, respectively, the first and second strap bottom attachment flaps being displaceable through the first and second strap openings, respectively, in connection with reversal of the backpack shell.

18. The reversible backpack of claim 17, wherein the first and second strap openings are vertically extending slits, the vertically extending slits being open portions of respective seams between adjacent material panels of the backpack shell.

19. The reversible backpack of claim 15, further comprising first and second quick release connectors, each of the first and second quick release connectors having:

a strap connector portion affixed to an upper end a respective one of the first and second carrying straps, and two shell top connector portions, each of the two shell top connector portions being complementary with and separately attachable to the strap connector portion, one of the two shell top connector portions being affixed to the first shell surface proximate to shell top the for use when the first shell surface is the exterior surface and the other of the two first shell top connector portions being affixed to the second shell surface proximate to the shell top for use when the second shell surface is the exterior surface.

* * * * *